US012723355B2

(12) United States Patent
Lai et al.

(10) Patent No.: US 12,723,355 B2
(45) Date of Patent: Sep. 1, 2026

(54) AUTOMATIC FORMING MACHINE FOR PULP MOLDING PRODUCT AND MANUFACTURING METHOD THEREFOR

(71) Applicant: Foshan City Meiwanbang Technology Co., Ltd., Foshan City (CN)

(72) Inventors: Tzung-Shen Lai, Yilan City (TW); Ri-Hua Rao, Guangdong Province (CN); Zhen-Jian Li, Guangdong Province (CN)

(73) Assignee: Foshan City Meiwanbang Technology Co., Ltd, Foshan City (CN)

( * ) Notice: Subject to any disclaimer, the term of this patent is extended or adjusted under 35 U.S.C. 154(b) by 134 days.

(21) Appl. No.: 18/247,280

(22) PCT Filed: May 21, 2021

(86) PCT No.: PCT/CN2021/000110
§ 371 (c)(1),
(2) Date: Mar. 30, 2023

(87) PCT Pub. No.: WO2022/241582
PCT Pub. Date: Nov. 24, 2022

(65) Prior Publication Data

US 2024/0018727 A1 Jan. 18, 2024

(51) Int. Cl.
*D21J 5/00* (2006.01)
*D21J 1/04* (2006.01)

(52) U.S. Cl.
CPC .. *D21J 5/00* (2013.01); *D21J 1/04* (2013.01)

(58) Field of Classification Search
CPC ..... D21J 5/00; D21J 1/04; D21J 3/00; D21J 7/00
See application file for complete search history.

(56) References Cited

U.S. PATENT DOCUMENTS

2016/0168793 A1 6/2016 Kuo et al.

FOREIGN PATENT DOCUMENTS

CN 102465477 A 5/2012
CN 105200866 A 12/2015
(Continued)

OTHER PUBLICATIONS

English translation of WO_2020142859_A1 retrieved from Espacenet (Year: 2025).*

(Continued)

*Primary Examiner* — Abbas Rashid
*Assistant Examiner* — Elisa H Vera
(74) *Attorney, Agent, or Firm* — Best & Flanagan LLP

(57) ABSTRACT

An automatic forming machine for a pulp molding product and a manufacturing method therefor. During manufacturing, a slurry suction mold immersed in a slurry box suctions a slurry to form a slurry layer, and then ascends to leave the slurry box to assemble with an upper hot pressing mold, which moves in from an external space, for extrusion to form a preform; then the slurry suction mold descends into the slurry box for a second round of slurry suction; the upper hot pressing mold suctions the preform and returns in a reverse direction to an original position; then a lower hot pressing mold ascends for assembling to hot press and shape the preform to form a pulp molding product, and the lower hot pressing mold suctions the pulp molding product and descends to the original position; and a material receiving mechanism then suctions the pulp molding product and leaves the lower hot pressing mold for separate collection. The automatic forming machine for a pulp molding product can perform, after slurry suction, rapid cold extrusion for dehydration and rapid hot-press forming, thereby increasing a manufacturing speed, shortening a production cycle, and reducing manufacturing cost.

5 Claims, 13 Drawing Sheets

(56) References Cited

FOREIGN PATENT DOCUMENTS

| | | | | | |
|---|---|---|---|---|---|
| CN | 108060617 | A | * | 5/2018 | ..... D21J 5/00 |
| CN | 108330741 | A | | 7/2018 | |
| CN | 109736139 | A | | 5/2019 | |
| CN | 111424467 | A | | 7/2020 | |
| CN | 111791296 | A | * | 10/2020 | ..... B26F 1/38 |
| KR | 20060046834 | A | | 5/2006 | |
| TW | M615618 | U | | 8/2021 | |
| WO | WO-2005017251 | A1 | * | 2/2005 | ..... D21B 1/00 |
| WO | WO-2020142859 | A1 | * | 7/2020 | ..... D21J 3/00 |

OTHER PUBLICATIONS

English description of CN108060617 retrieved in Espacenet (Year: 2025).*
English description of CN111791296A retrieved in Espacenet (Year: 2025).*
English Translation of WO2005017251A1 retrieved from Espacenet. (Year: 2025).*

* cited by examiner

AUTOMATIC FORMING MACHINE FOR PULP MOLDING PRODUCT AND MANUFACTURING METHOD THEREFOR

BACKGROUND OF THE INVENTION

The present invention is generally directed to an automatic forming machine for pulp molding product and manufacturing method thereof, and, more particularly, to a pulp suction automatic forming machine for pulp molding product and manufacturing method thereof, capable of enhancing manufacturing speed and shortening production cycle to reduce manufacturing cost.

DESCRIPTION OF THE RELATED ART

The environment protection has become a global concern. For the purpose of minimizing the damage of plastic products to the environment, it is currently developed that the paper pulp fiber material and/or plant fiber material are mixed and pulped to be the pulp raw material, then a pulp suction mold is used for pulp suction to adhere the pulp material, and then a product manufactured by the hot press forming technique is mostly referred to as molded pulp product or molded product or paper pulp molded product in order to distinguish from the plastic products. The name of pulp molding product is used herein for description. Pulp molding products have the advantage of easy recycling and remanufacturing and meet the development trend of environment-friendly reutilization, energy-saving, and carbon reduction. Therefore, pulp molding products are quickly accepted by the industrial and commercial circles as well as the general public. The common pulp molding products comprise bowls, plates, cups, and covers etc. Nowadays, pulp molding products are also increasingly used as packing materials, cushioning materials, and padding materials. There are various pulp molding products in the market with different sizes and styles.

The well-known manufacturing processes of the pulp molding product comprise "pulp suction and forming", "hot press shaping", "finished product transferring" and "final end finishing" and the pulp suction and forming" and "hot press shaping" are two primary manufacturing and forming processes of pulp molding products, which are usually completed by an "automatic forming machine for pulp molding product", and the processes of "finished product transferring" and "final end finishing" are the manufacturing process of collecting finished product to transfer to the finished end for arrangement (such as trimming, inspection, and packing) after the manufacturing and forming of the pulp molding products are finished. Obviously, the "automatic forming machine for pulp molding product" is an important driving force in manufacturing pulp molding products. Therefore, to manufacture high-quality pulp molding products, it is necessary to have a good "automatic forming machine for pulp molding product", combined with an appropriate manufacturing method (appropriate manufacturing steps).

The prior art automatic forming machine for pulp molding product is composed of various structures, and there are many different manufacturing methods. Basically, the automatic forming machine for pulp molding product and manufacturing method thereof used for manufacturing large-size pulp molding products (such as a cushioning box for 3C products) will be definitely different from those used for manufacturing small-size pulp molding products (such as a plate). The reason is that large-size pulp molding products and small-size pulp molding products will use different pulp suction method and pulp suction time, squeezing and dehydration method and squeezing and dehydration time, hot press shaping method and hot press shaping time. More simply said, the production cycles of these two kinds of pulp molding products are different. Therefore, the same automatic forming machine for pulp molding product and manufacturing method thereof cannot be used for manufacturing large-size and small-size pulp molding products. Appropriate adjustments must be made according to the different specifications of the pulp molding product to be manufactured.

The present inventor specialized in the design and manufacture of various automatic forming machines for pulp molding products, and various pulp molding products. Based on the inventor's long experience in dealing with various automatic forming machines for pulp molding products and various pulp molding products, the inventors have found that, during actual applications in manufacturing light, small and thin pulp molding products, the existing automatic forming machines for pulp molding products have the problem of wasting the production cycles. The reason is that, the existing various automatic forming machines for pulp molding products and manufacturing method thereof are all specifically designed for manufacturing large-size pulp molding products. The large-size pulp molding products are relatively thick. Some are even designed for multiplication of the thickness of the pulp molding products. Therefore, when the existing automatic forming machines for pulp molding products are used to manufacture light, small and thin pulp molding products, the pulp suction method and time, the squeezing and dehydration method and time, and the hot press shaping method and time are all excessive. The accumulated time of each production cycle cannot be reduced, and therefore the manufacturing cost cannot be reduced. This causes the problem of energy waste. In the present era of industrial development, time is money and it is a critical issue to speed up the production processes and lower the manufacturing cost. In view of this, the inventor had the idea to make improvements and develop an innovative automatic forming machine for pulp molding product to shorten the production cycle.

SUMMARY OF THE INVENTION

In view of the foregoing demand, the present inventor proceeds with a deep research and improvement in order to provide an automatic forming machine for pulp molding product and manufacturing method having new structure and forming, thereby solving the foregoing drawbacks. After the long-time great effort, the present invention is developed.

Accordingly, it is a primary object of the present invention to provide an automatic forming machine for pulp molding product and manufacturing method having a entirely new structure and manufacturing process.

It is also a primary object of the present invention to provide an automatic forming machine for pulp molding product and manufacturing method, capable of enhancing the manufacturing speed and shortening production cycle, thereby reducing manufacturing cost.

To achieve the forgoing purpose, the present application provides an automatic forming machine for pulp molding product, comprising: a pulp box, fixedly installed inside a central space, wherein the pulp material is contained inside the pulp box and the top surface of the pulp box is an open shape; a pulp suction mold, supported by a supporting piece passing through the pulp box to be in an upward state, wherein the supporting piece can perform a lifting action to drive the pulp suction mold to lift synchronously and in the zeroing state, the pulp suction molded is driven by the supporting piece to immerse in the pulp box and the pulp suction mold is connected with a first pumping device and able to receive the suction action or blow action of the first pumping device; a hot press upper mold, installed inside a side space and hung on a guide rail, wherein the side space is adjacent to the central space and located at one side of the central space, the mold face of the hot press upper mold faces downward and the mold face of the hot press upper mold and the mold face of the pulp suction mold are correspondingly symmetrical in shapes, the hot press upper mold is driven by an external power mechanism to perform a horizontally transverse movement along the guide rail, the hot press upper mold is connected with a second pumping device and able to receive the suction action or blow action of the second pumping device; and a hot press lower mold, installed inside the lateral space and located under the hot press upper mold, the mold face of the hot press lower mold faces upward, the mold face of the hot press lower mold and the mold shape of the hot press upper mold are correspondingly symmetrical in shapes, the bottom of the hot press lower mold is driven by an external power mechanism to perform vertically up and down movement, and the hot press lower mold is connected with a third pumping device and able to receive the suction action or blow action of the third pumping device.

According to the above-mentioned automatic forming machine for pulp molding product, the hot press upper mold comprises a first hot press upper mold and a second hot press upper mold, wherein the first hot press upper mold and the second hot press upper mold are respectively disposed inside a first side space and a second side space, both of the first side space and the second side space are adjacent to the central space and respectively located at the two sides of the central space, the first hot press upper mold and the second hot press upper mold hung on the same guide rail configured to pass through the upper space of the first side space, the central space and the second side space, both the mold faces of the first hot press upper mold and the second hot press upper mold face downward, both the mold faces of the first hot press upper mold and the second hot press upper mold and the mold face of the pulp suction mold are correspondingly symmetrical in shapes, both the first hot press upper mold and the second hot press upper mold are driven by an external power mechanism to perform a horizontally transverse movement along the guide rail, the first hot press upper mold and the second hot press upper mold are both connected with a pumping device and able to receive the suction action and blow action of the pumping device; the hot press lower mold comprises a first hot press lower mold and a second hot press lower mold, the first hot press lower mold and the second hot press lower mold are respectively installed inside the first side space and the second side space, the first hot press lower mold and the second hot press lower mold are respectively disposed below the first hot press upper mold and the second hot press upper mold, both the mold faces of the first hot press lower mold and the second hot press lower mold face upward, the mold faces of the first hot press lower mold and the second hot press lower mold are respectively symmetrical with the first hot press upper mold and the second hot press upper mold, the bottoms of the first hot press lower mold and the second hot press lower mold are both driven by an external power mechanism to perform a vertically up and down movement, and the first hot press lower mold and the second hot press lower mold are both connected with a pumping device and able to receive the suction and blow action of the pumping device.

The above-mentioned automatic forming machine for pulp molding product further comprises a material receiving mechanism configured outside the side space, wherein the material receiving mechanism has a vertical base resting on a fixed position and a straight rail is configured on a side of the vertical base; a horizontal rail is transversely and crossly configured on the straight rail, the horizontal rail extends a large section toward the side space, the horizontal rail can be pushed by an external power mechanism to perform an up and down movement along the straight rail and be controlled to stop moving anytime; a rail block is clamped on the horizontal rail and pushed by an external power mechanism to move transversely along the horizontal rail and can be controlled to stop moving anytime; and, a sliding bar is fixed under the rail block and the sliding bar can move transversely along the horizontal rail accompanying with the rail block and stop anytime accompanying with the rail block, the sliding bar extends a large section toward the side space and a adsorption member is configured below the sliding bar to generate a adsorption effect due to the connection with a vacuum suction mechanism.

According to the above-mentioned automatic forming machine for pulp molding product, wherein the material receiving mechanism comprises a first material receiving mechanism and a second material receiving mechanism respectively installed on the exterior of the first lateral space and the second lateral space.

According to the above-mentioned automatic forming machine for pulp molding product, wherein the hot press upper mold is provided with a plurality of air extraction holes on each pulp suction part on the mold face of the mold table, the air extraction holes are direct upwardly to the interior of the mold and further to arrive at an air chamber, the air chamber is outward through an air extraction middle section tube and bends downwardly to communicate to an air extraction gathering tube, the air is sucked by the air extraction mechanism connected with the air extraction gathering tube, and when the inner end of the air extraction middle tube is connected to the air chamber, the lower position of the inner end of the air extraction middle tube is lower than the air chamber.

According to the above-mentioned automatic forming machine for pulp molding product, wherein the mold faces of the mold tables of the hot press upper mold and the hot press lower mold are configured with a plurality of air blowing holes at each pulp suction part, the blowing holes toward to the interior of the mold tables go upwardly or downwardly to an air inlet tube and the air inlet tube is connected and collected for air intake via a air intake mechanism.

It is also a further object of the invention to provide a manufacturing method of an automatic forming machine for pulp molding product, utilizing the above-mentioned automatic forming machine for pulp molding product and taking the following steps:

(1) in the beginning, the pulp suction mold is immersed inside the pulp box and then the pumping device connected to the pulp suction mold is immediately activated to form a blank material layer on the mold face of the pulp suction mold;

(2) upon the pulp suction time ends, the supporting piece stretches to push the pulp suction mold to suck the blank material layer and leave the pulp box to move upward, and during the process, the pumping device connected to the pulp suction mold continues the suction function, thereby enabling the blank material layer to be dehydrated and dehumidified, and meanwhile, the hot press upper mold is driven by the connecting external power mechanism to move horizontally into the central space along the guide rail and is stopped at the position corresponding to the pulp suction mold and then, the upward moving pulp suction mold sucks the blank material layer and closes mold with the hot press upper mold to squeezes the blank material layer to dehydrate, and during the process, the pumping device connected to the hot press upper mold is started to suck, thereby enabling the blank material layer to dehydrate and dehumidify, and upon the mold closing and squeezing time ends, the blank material layer is dehumidified to become a primary blank, and then, the pumping device connected to the pulp suction mold transfers to be the blowing function to release the primary blank from the pulp suction mold and the hot press upper mold sucks the primary blank;

(3) then, the hot press upper mold sucks the primary blank and is driven by the connecting external power mechanism to reversely return to the first side space along the guide rail, stop at the position corresponding to the hot press lower mold, and then the hot press lower mold is pushed by the connecting external power mechanism to move upward and close mold with the hot press upper mold, thereby together proceeding with the hot press forming on the primary blank to totally dry the primary blank to be a pulp molding product, and during the process, the pumping devices connected with the hot press upper mold and the hot press lower mold both start the suction action to enable the primary blank to be dried to be the pulp molding product; and, (4) upon the hot press forming time ends, the pumping device connected to the hot press upper mold stops suction action, transfers to blowing action to release from the pulp molding product, and the hot press lower mold sucks the pulp molding product to move downward back for being collected.

According to the above-mentioned manufacturing method of an automatic forming machine for pulp molding product, wherein, after the hot press lower mold sucks the pulp molding product and moves downward to return, the rail block of the material receiving mechanism is pushed by an external power mechanism to move along the horizontal rail and drives the sliding bar to push the suction member to move synchronously, thereby enabling the portion of the sliding bar and the suction member to enter into the side space to enable the suction member facing directly the pulp molding product, and then, the horizontal rail is pushed by the external power mechanism to move downward along the straight rail until the suction member attaches to the pulp molding product, and meanwhile the vacuum suction mechanism connected to the suction member starts the suction action and the pumping device connected to the hot press lower mold stops suction action, thereby enabling the pulp molding product to be transferred to sucked by the suction member, and then, the horizontal rail moves upward along the straight rail to return, and meanwhile the sliding rail block reversely moves along the horizontal rail and drives the sliding bar and the suction member sucking the pulp molding product to move out of the first side space, and then, immediately, the suction member stops suction action and the pulp molding product is collected.

According to the above-mentioned manufacturing method of an automatic forming machine for pulp molding product, wherein, the hot press upper mold sucks the primary blank and moves reversely to return and meanwhile, the pulp suction mold stops blowing action and is driven by the supporting piece to move downward into the pulp box to return to the starting position for pulp suction, thereby enabling another blank material layer to be formed on the mold face of the pulp suction mold, and then, while the said hot press upper mold and hot press lower mold are proceeding to hot pressing and forming operation on the primary blank, the pulp suction mold sucks another blank material layer and leaves the pulp box to move upward, and meanwhile another hot press upper mold disposed in another side space moves transversely along the guide rail into the central space to close mold with the pulp suction mold to squeeze the another blank material layer to dehydrate to be another primary blank, and then, the pulp suction mold releases the another primary blank and moves downward into the pulp box and return to the starting position, the another hot press upper mold sucks the another primary blank and moves reversely along the guide rail into the another side space to return, and immediately, another hot press lower mold moves upward to close mode with the another hot press upper mold, thereby proceeding to another hot pressing and forming operation on another primary blank to totally dry the another primary blank to become another pulp molding product, and while another hot press forming time ends, the another hot press upper mold is released from the pulp molding product, and the another hot press lower mold sucks the another pulp molding product and moves downward to return, thereby being collected.

REFERENCE NUMERALS IN DRAWING FIGURES

Figure 1:
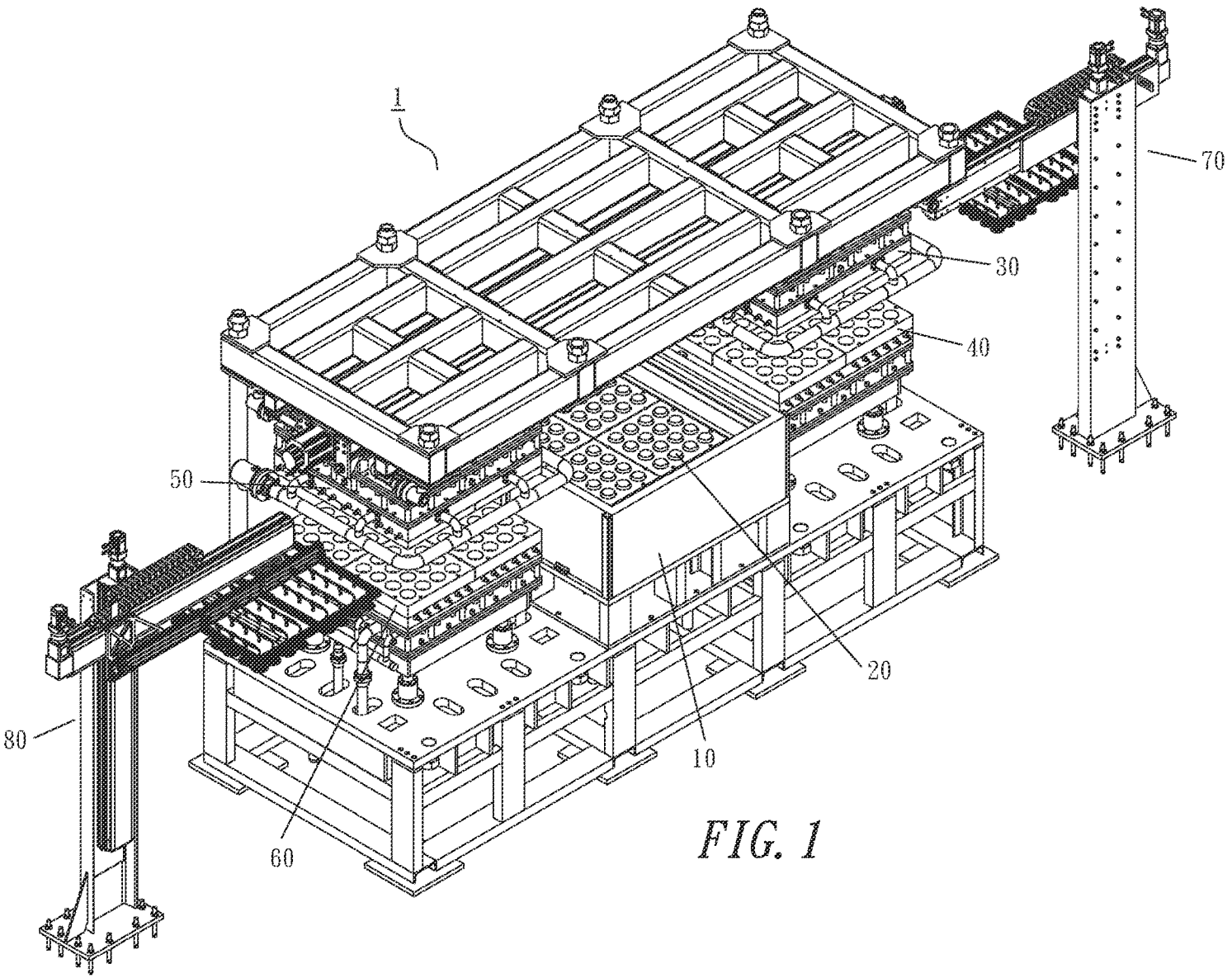
FIG. 1 is a perspective view of the pulp suction automatic forming machine for pulp molding product of the present invention.

1 Automatic forming machine for pulp molding product
10 Pulp box
11 Central space
12 Protection cover
20 Pulp suction mold
21 Supporting piece
30 First hot press upper mold
31 First side space
32 Guide rail
33 Mold table
331 Air suction holes
332 Air chamber
333 Air suction middle tube

334 Air suction gathering tube
335 Blowing holes
336 Air inlet tube
40 First hot press lower mold
50 Second hot press lower mold
51 Second side space
60 Second hot press lower mold
70 First material receiving mechanism
71 Vertical base
72 Straight rail
73 Horizontal rail
74 Sliding rail block
75 Sliding bar
76 Suction member
80 Second material receiving mechanism
81 Vertical base
82 Straight rail
83 Horizontal rail
84 Sliding rail block
85 Sliding bar
86 Suction member

DETAILED DESCRIPTION OF EMBODIMENTS OF THE INVENTION

To achieve the above-mentioned object, the features and advantages of the present invention will become apparent from the following description of the invention which refers to the preferred embodiments and the accompanying drawings.

The present invention claims an automatic forming machine for pulp molding product, and meanwhile claims a manufacturing method of an automatic forming machine for pulp molding product, as described following.

Figure 2:
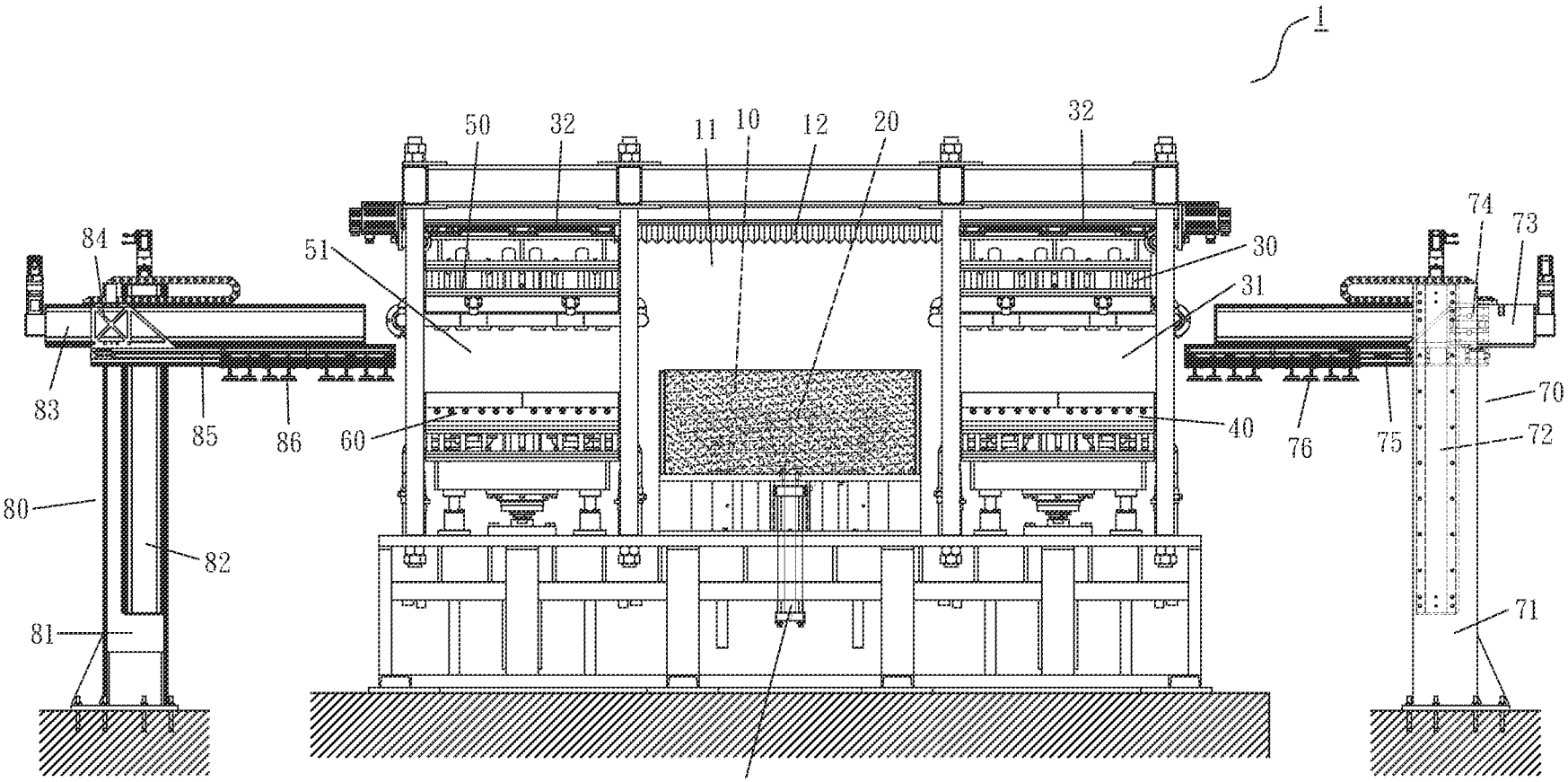
FIG. 2 is a front view of the pulp suction automatic forming machine for pulp molding product of the present invention.

The automatic forming machine for pulp molding product disclosed in the present invention is an automatic forming machines, particularly suitable for manufacturing light, small and thin pulp molding products. As shown in FIGS. 1 and 2, the structure of the automatic forming machine for pulp molding product 1 comprises:

a pulp box 10, fixedly installed inside a central space 11, and the pulp material is filled inside the pulp box 10, having an open top;

a pulp suction mold 20, supported by a supporting piece 21 (such as a power cylinder, with no restriction) passing through the pulp box 10, having an upward mold face, wherein the supporting piece 21 can perform a lift action to drive the pulp suction mold 20 to lift synchronously, and while in the zeroing state (or starting state), driven by the supporting piece 21, the pulp suction mold 20 is immersed inside the pulp box 10, namely, in the zeroing state, the mold face of the pulp suction mold 20 is lower than the pulp material surface of the pulp box 10, the pulp suction mold 20 is connected with a first pumping device, capable of receiving the suction (vacuum) or blowing (air blow) action of the first pumping device;

A first hot press upper mold 30, configured inside a first side space 3 and hung on a guide rail 32, wherein the first side space 31 is adjacent to the central space 11 and located on one side of the central space 11, such as, located on the right side of the central space 11. The mold face of the first hot press upper mold 30 faces downward and the mold face of the first hot press upper mold 30 and the mold face of the pulp suction mold 20 are correspondingly symmetrical in shapes, the first hot press upper mold 30 is driven by an external power mechanism to move horizontally and transversely along the guide rail 32 as needed, and the first hot press upper mold 30 is connected with a second pumping device, capable of receiving the suction (vacuum) or blowing (air blow) action of the second pumping device;

A first hot press lower mold 40, configured inside the first side space 31 and located below the first hot press upper mold 30, wherein the mold face of the first hot press lower mold 40 is upward and the mold face of the first hot press lower mold 40 and the mold face of the first hot press upper mold 30 are correspondingly symmetrical in shapes. The bottom of the first hot press lower mold 40 is driven by an external power mechanism (such as a power cylinder, with no restriction) to perform an upright up and down movement as needed, and the first hot press lower mold 40 is connected with a third pumping device, capable of receiving the suction (vacuum) or blowing (air blow) action of the third pumping device;

A second hot press upper mold 50, configured inside a second side space 51 and hung on the same guide rail 32, wherein the second side space 51 is adjacent to the central space 11 and located on the other side of the central space 11, such as, on the left side of the central space 11. The guide rail 32 is passing through and installed inside the upper space of the first side space 31, the central space 11 and the second side space 51 and a protection cover 12 (as shown in FIG. 2) is hung on the position of the upper space of the central space to protect the guide rail 32. The mold face of the second hot press upper mold 50 is downward and the mold face of the second hot press upper mold 50 and the mold face of the pulp suction mold 20 are correspondingly symmetrical in shapes. The second hot press upper mold 50 is driven by an external power mechanism to move horizontally and transversely along the guide rail 32 as needed. The second hot press upper mold 50 is connected with a fourth pumping device, capable of receiving the suction (vacuum) or blowing (air blow) action of the fourth pumping device. As shown in FIGs., the structure of the second hot press upper mold 50 is identical to the aforesaid first hot press upper mold 30 but merely respectively locate inside the first side space 31 and second side space 51 adjacent to two sides of the central space 11;

A second hot press lower mold 60, configured inside the second side space 51 and located below the second hot press upper mold 50, wherein the mold face of the second hot press lower mold 60 is upward and the mold face of the second hot press lower mold 60 and the mold face of the second hot press upper mold 50 are correspondingly symmetrical in shapes. The bottom of the second hot press lower mold 60 is driven by an external power mechanism (such as a power cylinder, with no restriction) to perform an upright up and down movement as needed. The second hot press lower mold 60 is connected with a fifth pumping device, capable of receiving the suction (vacuum) or blowing (air blow) action of the fifth pumping device. As shown in FIGs., the structure of the second hot press lower mold 60 is identical to the aforesaid first hot press lower mold 40 but merely respectively locate inside the first side space 31 and second side space 51 adjacent to two sides of the central space 11;

A first material receiving mechanism 70, configured outside the first side space 31, wherein the first material receiving mechanism 70 comprises a vertical base 71, resting fixedly on a platform or the ground and a straight rail 72 is configured on one side of the vertical base 71 and a horizontal rail 73 is transversely and crossly configured on the straight rail 72. The horizontal rail 73 extends a large section toward the first side space 31, the horizontal rail 73 can be driven by an external power mechanism to move, performing an up and down movement along the straight rail 72 and stopping action at any time due to be controlled. A sliding rail block 74 is configured on the horizontal rail 73, capable of being pushed by a different external power mechanism to move transversely along the horizontal rail 73 and controlled to stop action at any time. A sliding bar 75, fixedly configured under the rail block 74, thereby accompanying with the sliding rail block 74 to perform a transverse movement along the horizontal rail 73 and to stop action at any time. The sliding bar 75 also extends a large section toward the first side space 31 and a plurality of suction components 76 are configured below the sliding bar 75, capable of having a suction function due to that the rear end connected to a vacuum suction mechanism; and A second material receiving mechanism 80, configured outside the second side space 51, wherein the second material receiving mechanism 80 is identical to the aforesaid first material receiving mechanism 70, comprising a vertical base 81 fixedly resting on a platform or the ground and a straight rail 82 is also configured on one side of the vertical base 81 and also a horizontal rail 83 is transversely and crossly configured on the straight rail 82. The horizontal rail 83 extends a large section toward the second side space 51 and the horizontal rail 83 can be driven by an external power mechanism to move, performing an up and down movement along the straight rail 82 and stop action at any time due to be controlled. Similarly, a sliding rail block 84 is set up on the horizontal rail 83, capable of being pushed by a different external power mechanism to move transversely along the horizontal rail 83 and stop moving at any time due to be controlled. Similarly, a sliding bar 85 is fixedly installed under the sliding rail block 84, as well, capable of accompanying with the sliding rail block 84 to move transversely along the horizontal rail 83 and stop moving at any time. The sliding bar 85 also extends a large section toward the second side space 51 and a plurality of suction components 86 are configured below the sliding bar 85, capable of having a suction function due to that the rear end connected to a vacuum suction mechanism.

The description as above is the basic structural constitution of the automatic forming machine for pulp molding product 1 in the present invention. Specifically, as the above-mentioned external power mechanisms and the first, second, third, fourth and fifth pumping devices at various positions are not the main components of the present invention, and their functions are obvious, they are not depicted to simplify the drawings.

Figure 3:
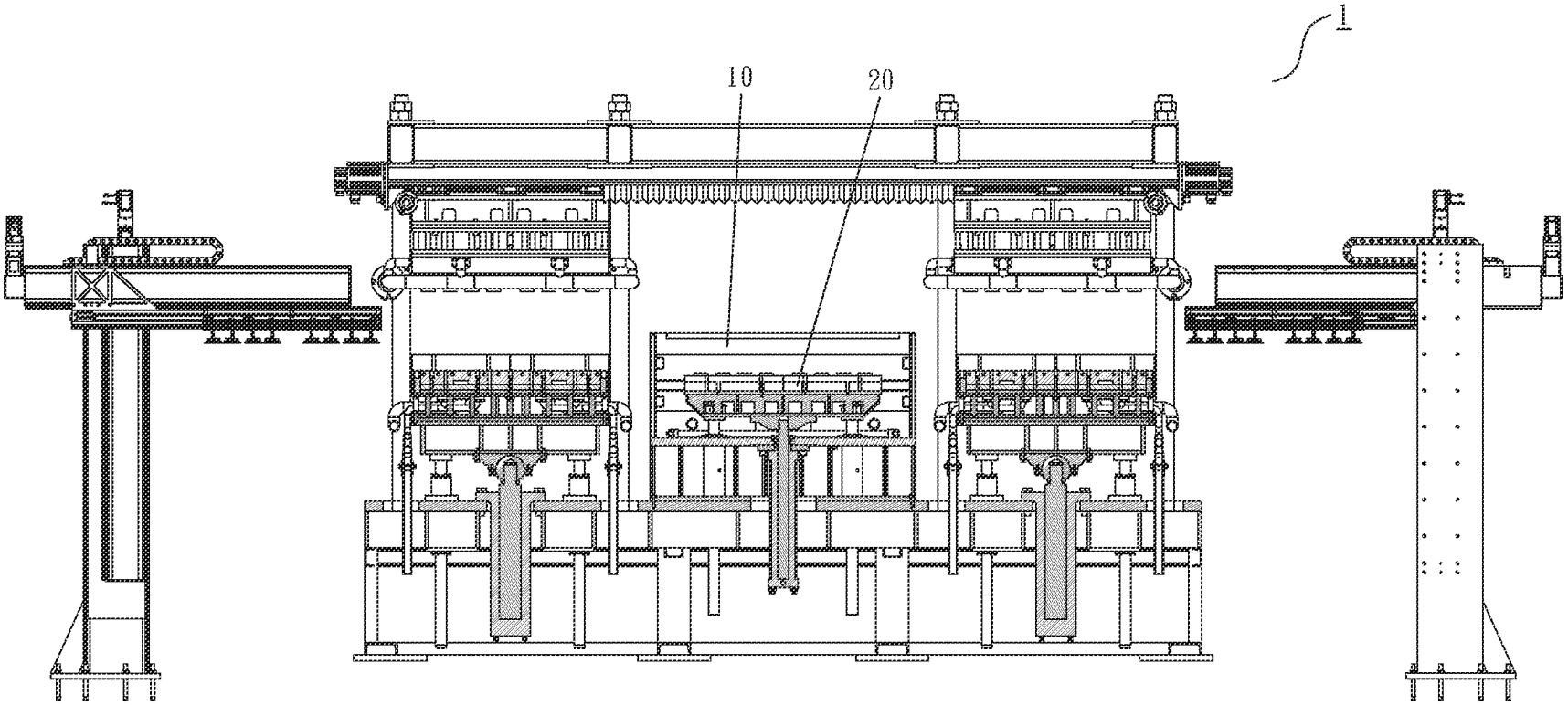
FIGS. 3-9 are schematic views of successive steps of the manufacturing method of the automatic forming machine for pulp molding product in the present invention.
Figure 4:
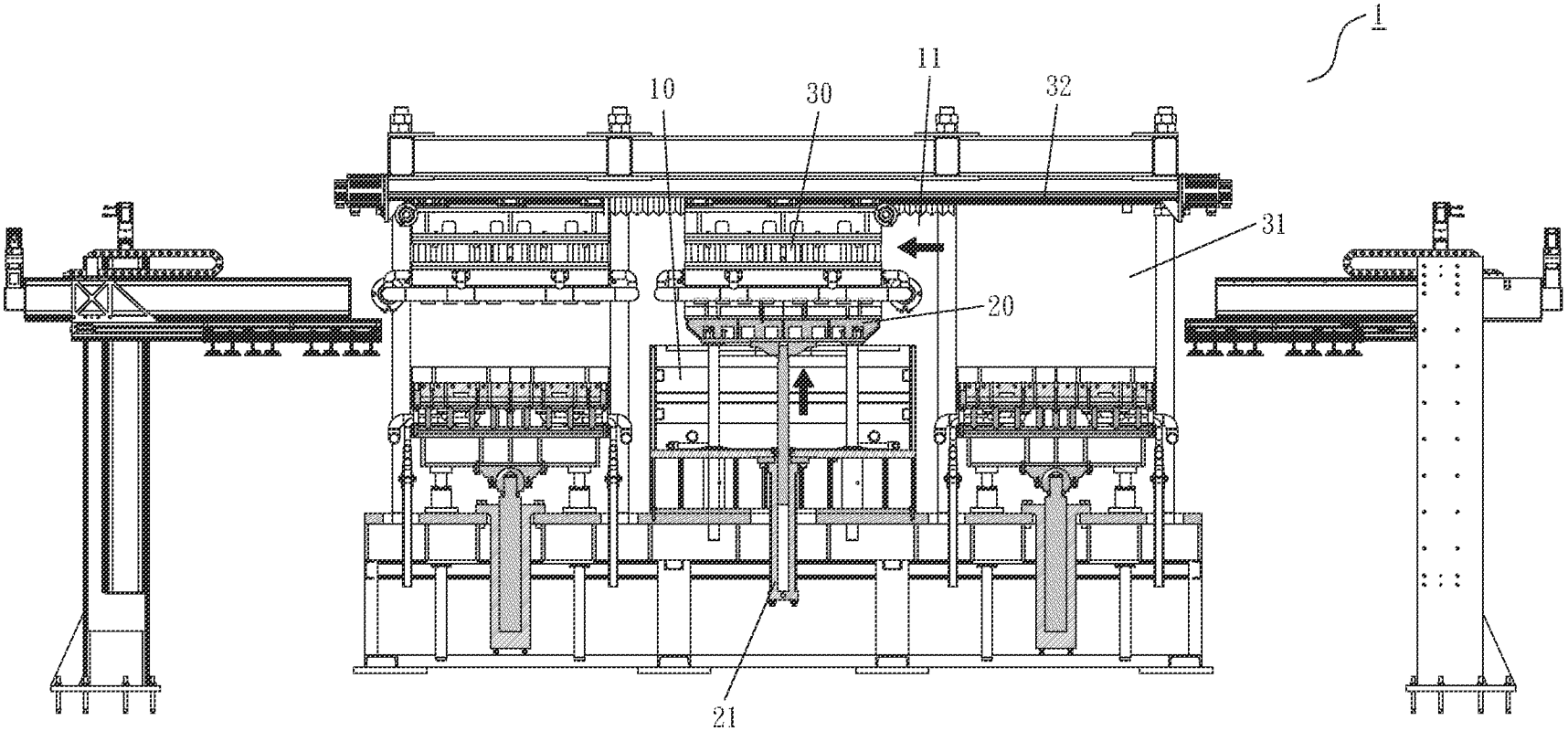
Figure 5:
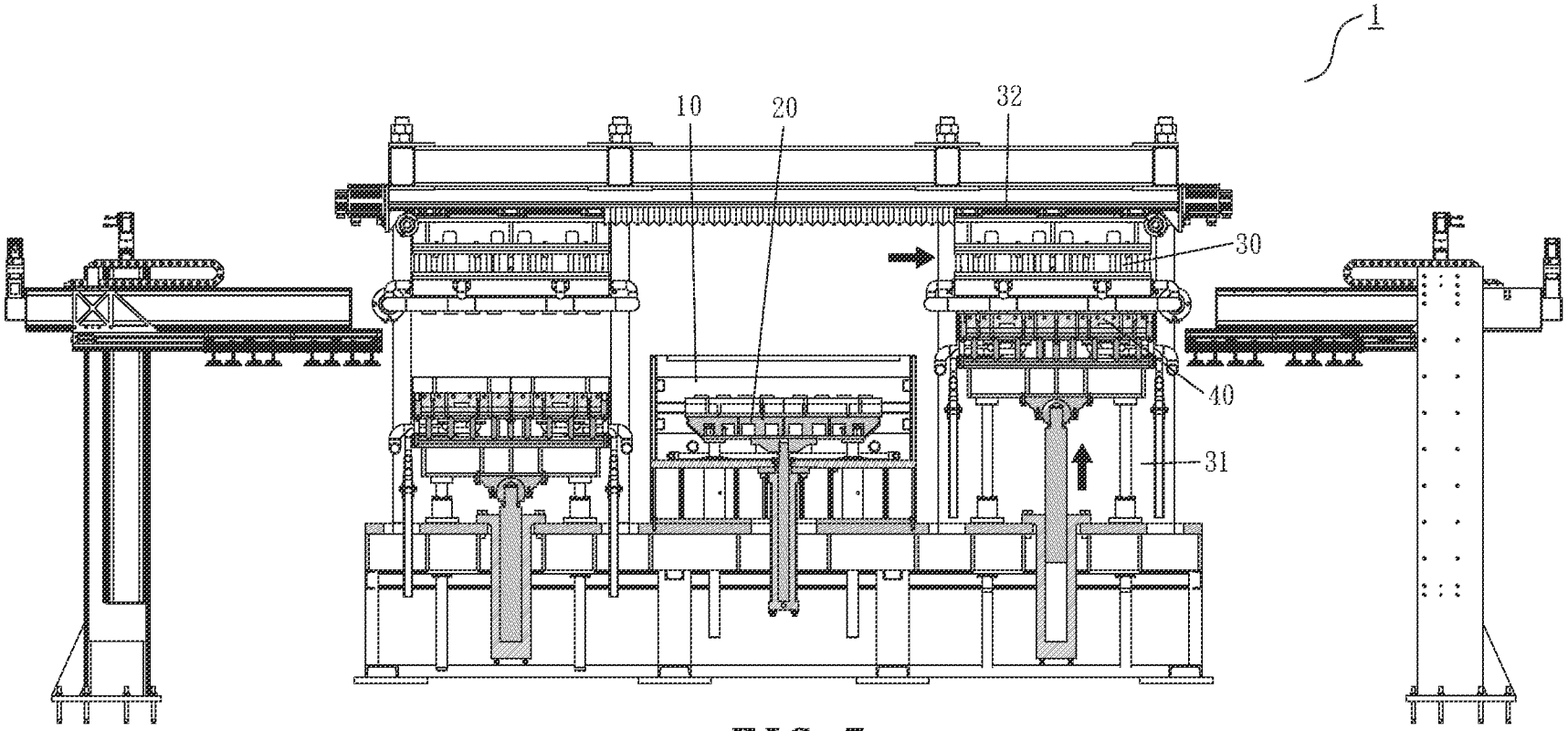

According to the aforesaid structural constitution of the automatic forming machine for pulp molding product 1, the present invention also claims a manufacturing method of the automatic forming machine for pulp molding product, which uses the aforesaid automatic forming machine for pulp molding product 1 and includes the following steps:

1. As shown in FIG. 3, initially, the pulp suction mold 20 is immersed inside the pulp box 10 and then, the first pumping device connected to the pulp suction mold 20 is activated to start the pulp suction and a blank material layer is formed on the mold face of the pulp suction mold 20. It must be further recited that the mold face of the pulp suction mold 20 can be configured with a plurality of pulp suction parts, thereby enabling the plurality of pulp suction parts all sucking pulp to form a plurality of blank material layers at the same time.
2. As shown in FIG. 4, when the pulp suction time ends, the supporting piece 21 stretches to push the pulp suction mold 20 to suck a blank material layer and leave the pulp box 10 to move upwardly. During the process, the first pumping device continues the suction action, enabling the blank material layer to be gradually dehydrated and dehumidified. While the pulp suction mold 20 is moving upwardly, the first hot press upper mold 30 is also driven by the connecting external power mechanism to move transversely along the guide rail 32 into the central space 11 and stops at the position corresponding to the pulp suction mold 20. Then immediately, the pulp suction mold 20 moving upwardly sucks the blank material layer and closes mold with the first hot press upper mold 30 to squeeze the blank material layer to dehydrate. During the process, the second pumping device connected to the first hot press upper mold 30 also starts suction function, enabling the blank material layer to be dehydrated and dehumidified gradually. When a short time for mold closing and squeezing ends, the blank material layer is dehumidified to be a primary blank. Then, immediately, the first pumping device connected to the pulp suction mold 20 stops suction function, transferring to the blowing (air blow) mode to release from the primary blank. The second pumping device connected to the first hot press upper mold 30 maintains the suction action to suck the primary blank. It must be further recited that, during the process shown in FIG. 4, the first hot press upper mold 30 does not perform a hot press but is used as a cold press mold.
3. As shown in FIG. 5, then immediately, the first hot press upper mold 30 sucks the primary blank and is driven by the connecting external power mechanism to reversely move into the first side space 31 along the guide rail 32 and return, stopping at the position corresponding to the first hot press lower mold 40 and immediately, the first hot press lower mold 40 is pushed by the connecting external power mechanism to move upwardly and close mode with the first hot press upper mold 30. Meanwhile, the primary blank is between the first hot press upper mold 30 and the first hot press lower mold 40. Then, the first hot press upper mold 30 and the first hot press lower mold 40 start the hot press form action on the primary blank until completely drying the primary blank to be a pulp molding product. During the process, the second and third pumping device both start suction function to generate a heat cycle, enabling the primary blank to be dried quickly to become a pulp molding product. Meanwhile, when the first hot press upper mold 30 sucks the primary blank to move reversely and return, the pulp suction mold 20 stops blowing action and is driven by the supporting piece 21 to move downwardly into the pulp box 10 and return to the zeroing (starting) position. Meanwhile, the first pumping device connected to the pulp suction mold 20 starts suction function again to perform the second round of pulp suction, enabling a blank material layer to be form on the mold face of the pulp suction mold 20 again. It must be further recited that, at the same time when the first hot press upper mold 30 and the first hot press lower mold 40 perform hot press forming function on the primary blank, the pulp suction mold perform suction function to form another blank material layer which belongs to another (the second) production cycle, namely, when the hot press shaping process of the first production cycle is still going on, the pulp suction process of the second production cycle has started.

Figure 6:
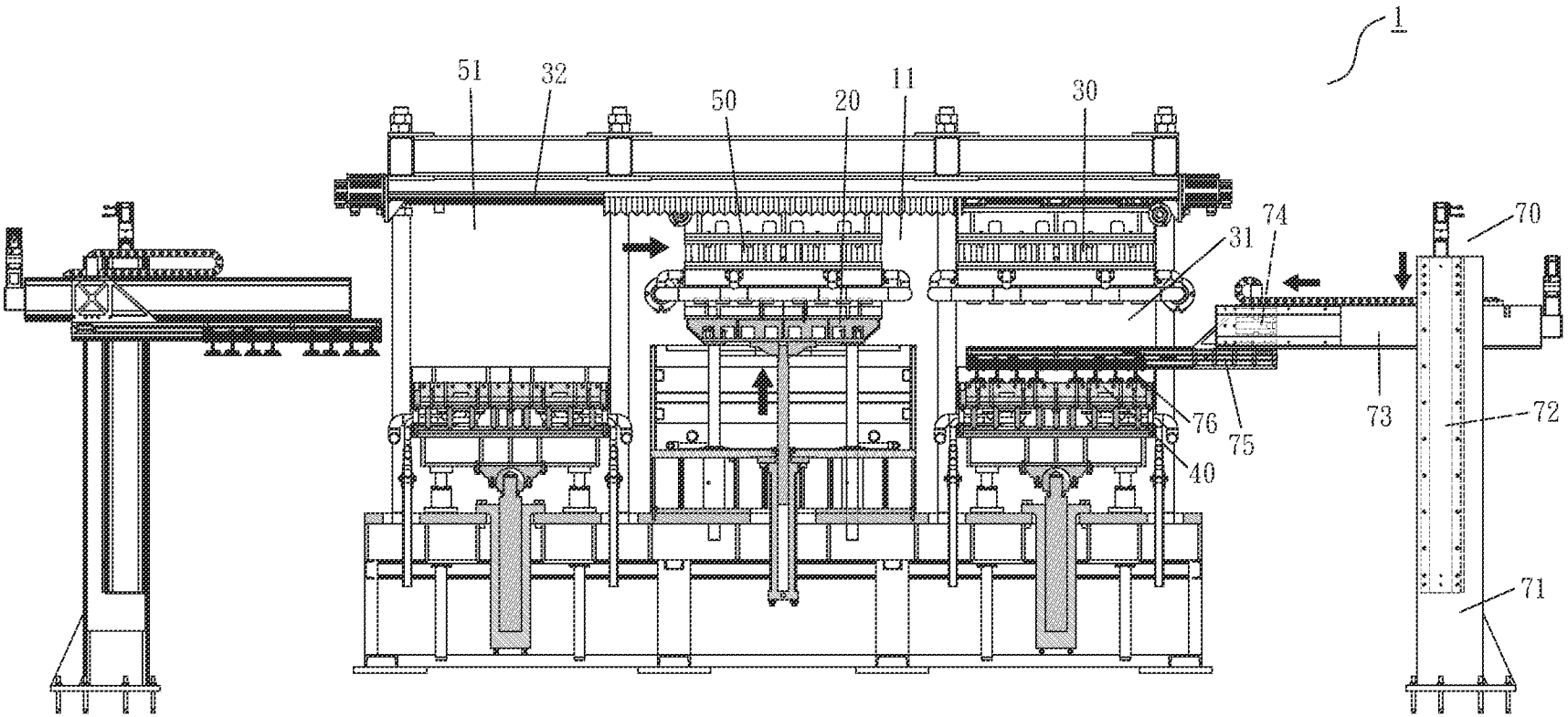

4. As shown in FIG. 6, when the hot press forming time ends, the primary blank is already dried to be a pulp molding product, and then immediately, the second pumping device connected to the first hot press upper mold 30 stops suction function, changing to the blowing (air blow) function to release from the pulp molding product. The third pumping device connected to the first hot press lower mold 40 maintains the sucking action to suck the pulp molding product and then, the first hot press lower mold 40 sucks the pulp molding product to move downwardly and return. Further, immediately, the sliding rail block 74 of the first material receiving mechanism 70 is pushed by the external power mechanism to move along the horizontal rail 73, driving the sliding bar 75 to push the plurality of suction components 76 to move synchronously, thereby enabling the portion of the sliding bar 75 and the plurality of suction components 76 jointly to enter the first side space 31 and stop after each of the plurality of suction components 76 facing directly each pulp molding product, and then, the horizontal rail 73 is pushed by the external power mechanism to move downwardly in a short distance along the straight rail 72 and stop after the suction components 76 touch the pulp molding product. Meanwhile, the vacuum suction mechanism connected to the suction component 76 starts suction action and the third pumping device connected to the first hot press lower mold 40 stops suction action, thereby enabling the pulp molding product is transferred to be sucked by the suction component 76. During the above action, the action of the second production cycle is also continuing, as shown in FIG. 6, the pulp suction mold 20 sucks the blank material layer sucking the pulp again to leave the pulp box 10 and moves upwardly, and meanwhile, the second hot press upper mold 50 also moves transversely along the guide rail 32 to enter the central space 11 and closes mold with the pulp suction mold 20 to squeeze the blank material layer for dehydration. These actions are totally the same as the actions carried out by the aforesaid first hot press upper mold 30 and therefore no further description is made herein.

Figure 7:
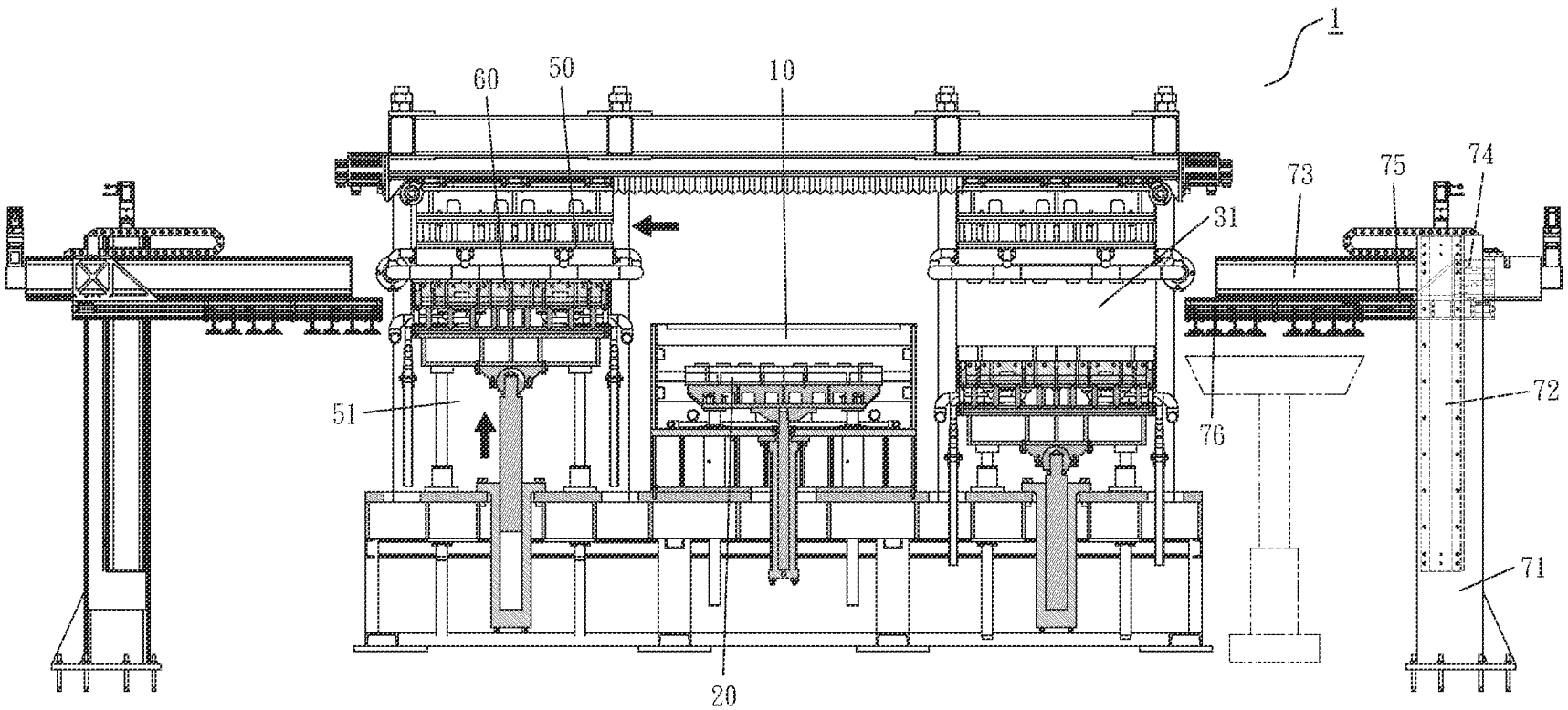

5. Then, as shown in FIG. 7, the action of the first production cycle is that the horizontal rail 73 moves upwardly along the straight rail 72 and return, meanwhile, the sliding rail block 74 moves reversely along the horizontal rail 73, driving the sliding bar 75 accompanying with the plurality of suction components 76 (sucking a plurality of pulp molding products) to withdraw to the exterior of the first side space 31. At the same time of action, a container used for collection is set below the plurality of suction components 76 (sucking a plurality of pulp molding products), so the suction components 76 immediately stop suction action to enable the plurality of pulp molding products to enter the product collection container. However, the process of product collection is not covered by the scope of the present invention, no further description is made herewith. During the above action, the actions of the second production cycle continue, as shown in FIG. 7, the second hot press upper mold 50 sucks the primary blank and moves reversely along the guide rail 32 to enter the second side space 51 and return, and then, immediately, the second hot press lower mold 60 moves upwardly to close mold with the second hot press upper mold 50 and perform the hot press forming action on the primary blank of the second production cycle to be totally dried to become a pulp molding product. During the process, the pulp suction mold 20 moves downwardly to enter the pulp box 10 and return to the zeroing status (starting), and immediately starts the third round of pulp suction, thereby enabling the mold face of the pulp suction mold 20 to form a blank material layer. It can be highlighted that, during the transfer and collection of the pulp molding products belonging to the first production cycle, the hot press forming of the second production cycle is also going on, and meanwhile, the pulp suction of the third production cycle is started. Therefore, the first, second, and third production cycles can coexist and be carried out in sequence to greatly shorten production cycle.

Figure 8:
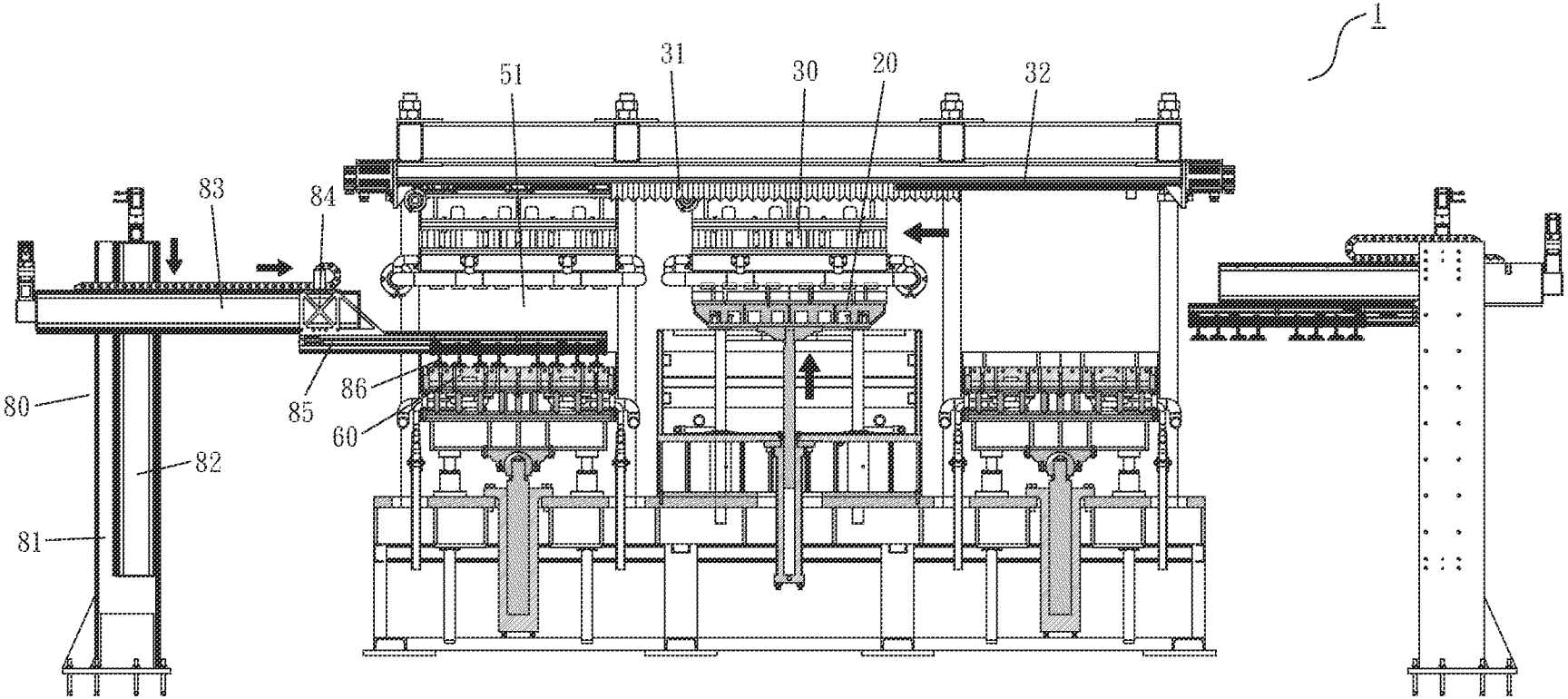

6. Then, as shown in FIG. 8, the actions belonging to the second production cycle are: upon completion of the hot press shaping time, the second hot press lower mold 60 sucking the pulp molding product moves downward to reset. Meanwhile, the rail block 84 of the second material receiving mechanism 80 drives the slide bar 85 to push the plurality of suction components 86 to move simultaneously along the horizontal rail 83, so that part of the slide bar 85 and the plurality of suction components 86 both enter the second lateral space 51, till each of the plurality of suction components 86 is aligned to each pulp molding product, Then, the horizontal rail 83 moves downward along the straight rail 82 till the suction components 86 touch the pulp molding products. Then, the suction components 86 start suction, and the second hot press lower mold 60 stops suction, so that the pulp molding products are transferred and sucked by the suction components 86. During the above action, the actions belonging to the third production cycle continue. As shown in FIG. 8, after this round of pulp suction, the pulp suction mold 20 sucking the third blank material layer moves upward to leave the pulp box 10. Meanwhile, the first hot press upper mold 30 moves horizontally along the guide rail 32 and re-enter the central space 11 to clamp with the pulp suction mold 20 to squeeze the blank material layer for dehydration. These actions are totally the same as those carried out by the aforesaid first hot press upper mold 30 and second hot press upper mold 50 and are therefore not repeated again.

Figure 9:
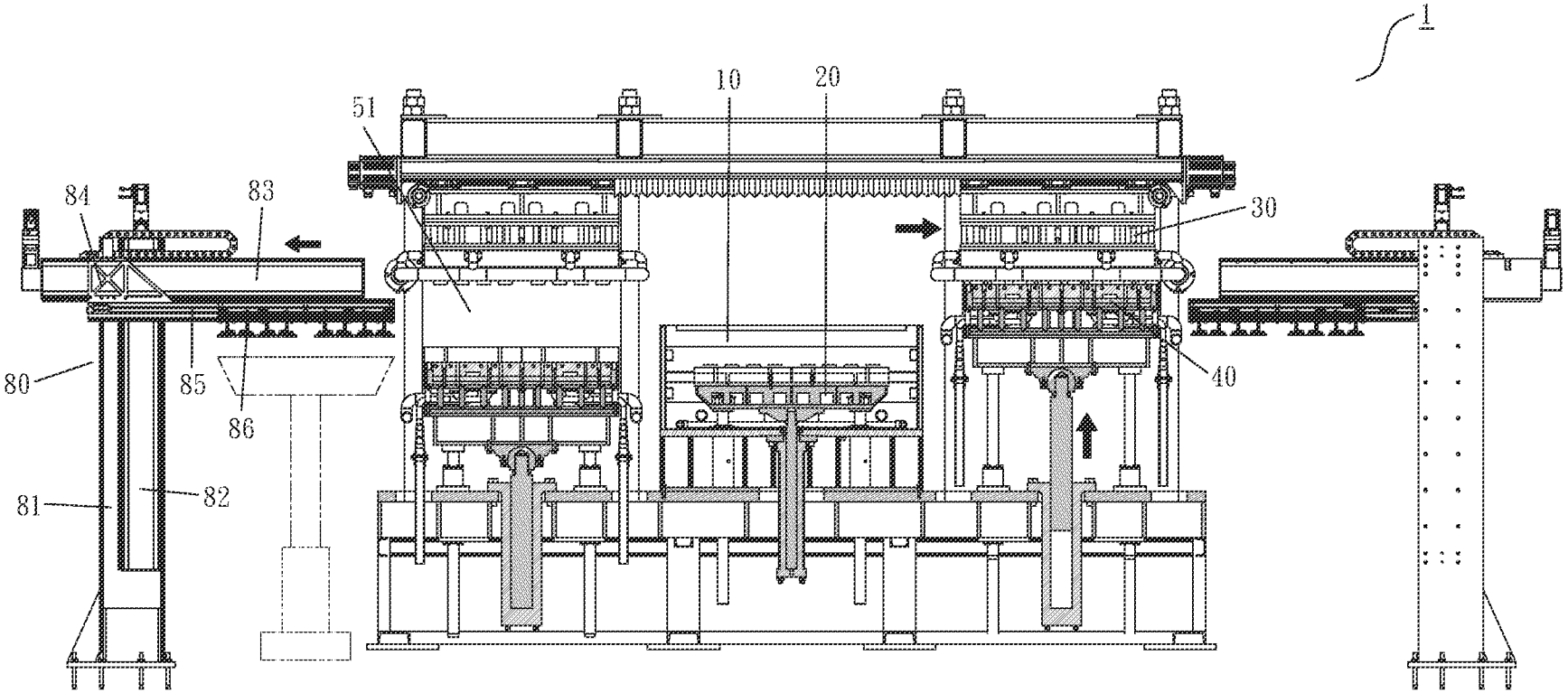
Figure 10:
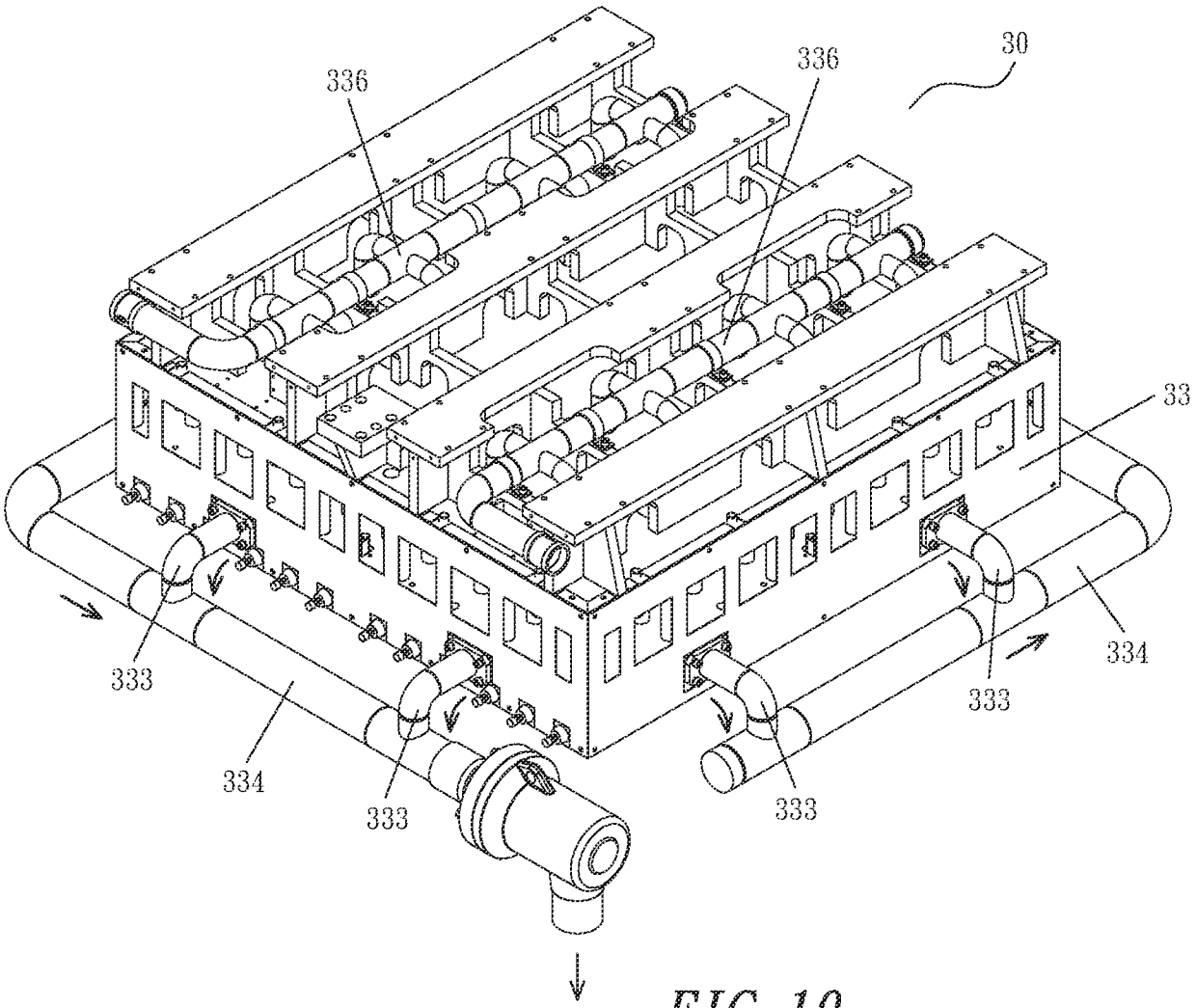
FIG. 10 is a perspective view of the first hot press upper mold of the present invention.
Figure 11:
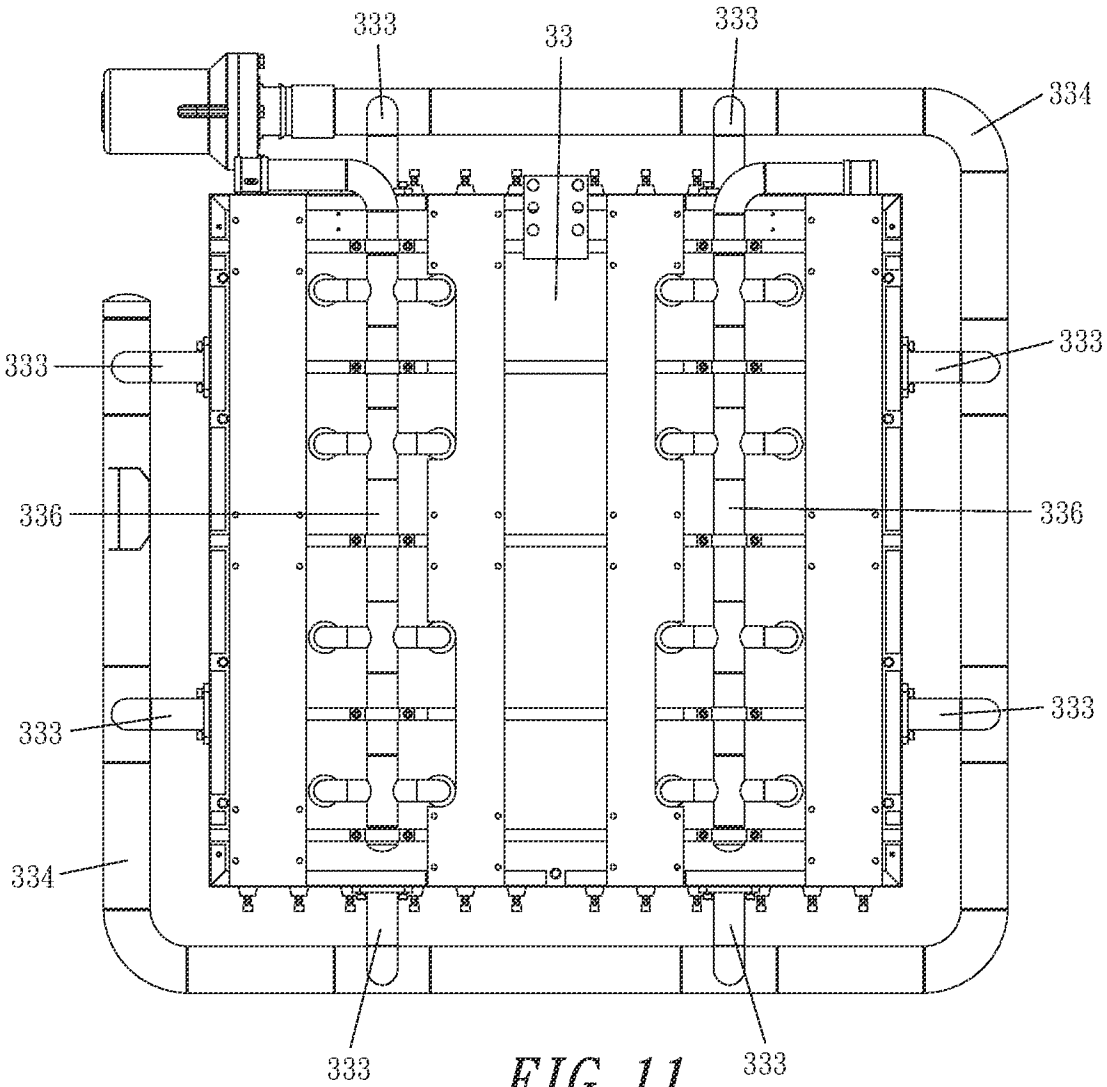
FIG. 11 is a top view of the first hot press upper mold of the present invention.

7. As shown in FIG. 9, the actions belonging to the second production cycle are as follow: the horizontal rail 83 moves upward along the straight rail 82 to reset. Meanwhile, the rail block 84 moves in the opposite direction along the horizontal rail 83, and drives the slide bar 85 together with the plurality of suction components 86 (sucking a plurality of pulp molding products) to withdraw out of the second lateral space 51. During the above actions, the container for product collection is waiting under the plurality of suction components 86. Then, the suction components 86 stop suction, so that the plurality of pulp molding products enter the product collecting container. As the process of product collection is not covered by the scope of the present invention, it is not detailed herein. During the above actions, the actions belonging to the third production cycle continue. As shown in FIG. 7, the first hot press upper mold 30 sucking the primary blank moves in the opposite direction along the guide rail 32 into the first lateral space 31 to reset. Then, the first hot press lower mold 40 moves upward to clamp with the first hot press upper mold 30, to carry out the hot press shaping of the primary blank, which belongs to the third production cycle, to form a pulp molding product. During the process, the pulp suction mold 20 moves downward again to re-enter the pulp box 10 to the reset (starting) position, and immediately start the fourth round of pulp suction. The mold face of the pulp suction mold 20 is again formed with a blank material layer. Therefore, it can be highlighted that, when the pulp molding product is transferred and collected—a process belonging to the second production cycle, the process of hot press shaping belonging to the third production cycle goes on, and meanwhile, the process of pulp suction belonging to the fourth production cycle is started. Thus, when the first production cycle is completed, the second, third, and fourth production cycle coexist and continue in sequence. The convenience of allowing coexistence of multiple production cycles can greatly enhance manufacturing speed and shorten production cycle to reduce manufacturing cost.

After all the steps described above are completed one by one, the anticipated pulp molding products are manufactured. As the first, second, and third production cycles or the second, third, and fourth production cycles (and so on) can coexist and go on in sequence, the present invention can truly enhance manufacturing speed and shorten production cycle to reduce manufacturing cost invention object.

As we can see from the aforesaid structural constitution and manufacturing steps of the automatic forming machine for pulp molding product 1, the first hot press upper mold 30 and the second hot press upper mold 50, the first hot press lower mold 40 and the second hot press lower mold 60, and the first material receiving mechanism 70 and the second material receiving mechanism 80 are actually of the same structure and are used in the same manufacturing steps, only differentiated by their locations on either side of the central space 11. Therefore, in actual applications, except that the automatic forming machine for pulp molding product 1 must have the pulp box 10 and pulp suction mold 20, in case only the first hot press upper mold 30, the first hot press lower mold 40 and the first material receiving mechanism 70 exist, or in case only the second hot press upper mold 50, the second hot press lower mold 60, and the second material receiving mechanism 80 exist, after pulp suction, quick cold squeezing (dehydration) and quick hot press shaping can also be realized to enhance manufacturing speed and shorten production cycle to reduce manufacturing cost invention object.

In the above manufacturing steps of the manufacturing method disclosed in the invention, when the first hot press upper mold 30 (or the second hot press upper mold 50) and the first hot press lower mold 40 (or the second hot press lower mold 60) clamp to carry out hot press shaping, the first hot press upper mold 30 (or second hot press upper mold 50) and the first hot press lower mold 40 (or second hot press lower mold 60) will both carry out the sucking (vacuum) or blowing (wind) process. Specifically, the sucking process is mainly used to suck the vapor from the primary blank, and the blowing process is used to release the pulp molding product.

Figure 12:
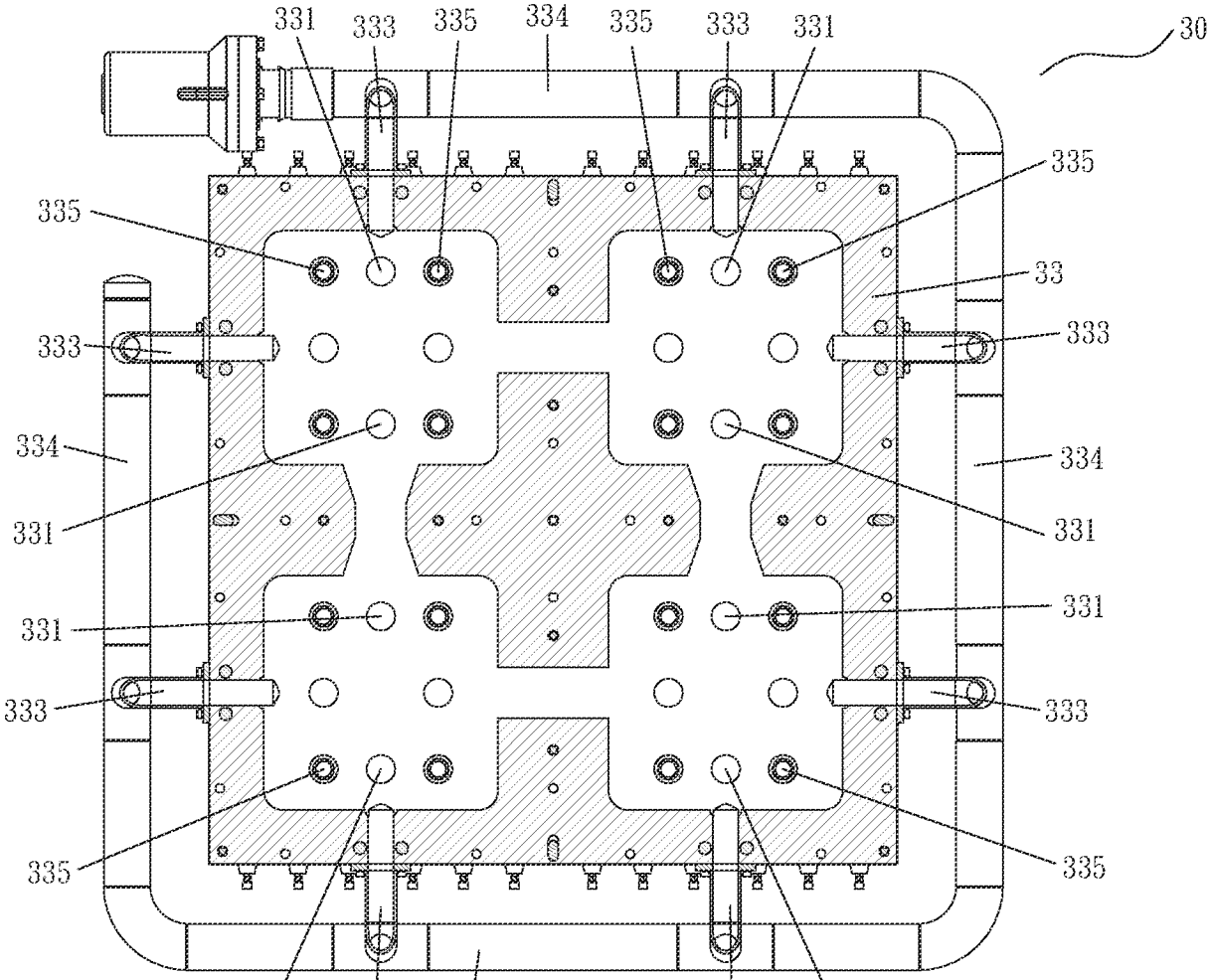
FIG. 12 is a bottom view of the first hot press upper mold of the present invention.
Figure 13:
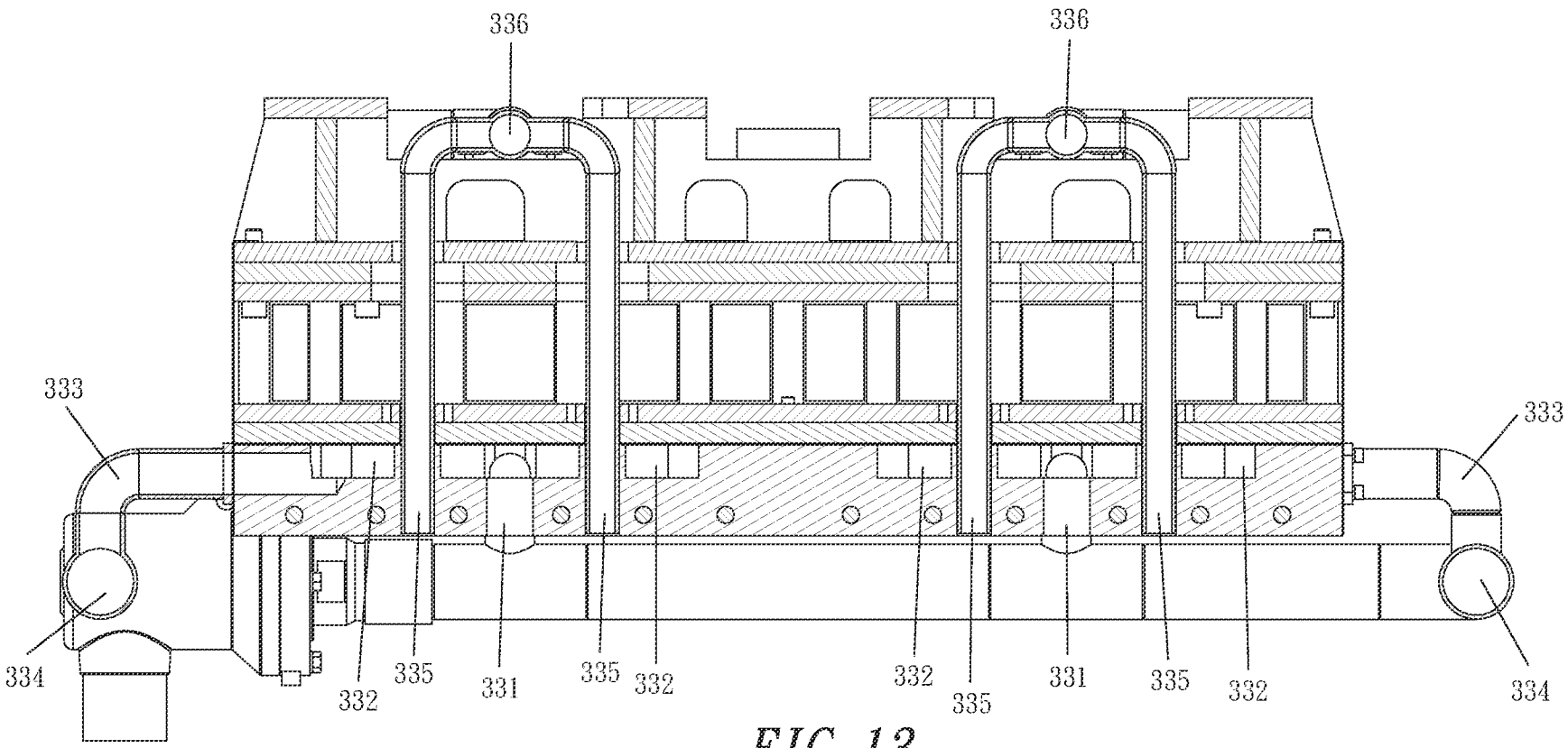
FIG. 13 is a sectional view of the first hot press upper mold of the present invention.

In the case of the first hot press upper mold 30 for example, the structure of the first hot press upper mold 30 is as shown in FIG. 10-FIG. 13. A plurality of air suction holes 331 (as shown in FIG. 12) are configured on the mold face of the mold 33 at each pulp suction part. The air suction holes 331 go into the mold 33 and then upward to an air chamber 332 (as shown in FIG. 13). Then, the air chamber 332 is communicated to an air suction gathering tube 334 (see FIG. 10 and FIG. 11) through an air suction intermediate tube 333 that goes outward and then bends downward. Air is discharged through the suction of air sucking mechanism connected to the rear end of the air suction gathering tube 334. As we can see from FIG. 13, when the inner end of the air suction intermediate tube 333 is communicated to the air chamber 332, the bottom position of the inner end of the air suction intermediate tube 333 is lower than the air chamber 332. Its function is as follows: Because vapor is sucked upward through the air suction holes 331 into the air chamber 332, when the vapor goes into the air chamber 332, due to the slight fall of temperature, it is converted to water, which drops onto the bottom the air chamber 332. Now, as the bottom position of the inner end of the air suction intermediate tube 333 is lower than the air chamber 332, the water inside the air chamber 332 will go into the air suction intermediate tube 333 and be sucked out completely. Meanwhile, as the air suction intermediate tube 333 goes outward and then bends downward to connect with the air suction gathering tube 334, the water can be completely discharged, thus avoiding back flow to the air chamber 332. The structure of the second hot press upper mold 50 is completely the same as the structure shown in FIG. 10-FIG. 13, and is therefore not depicted and described again.

As for the first hot press lower mold 40 and the second hot press lower mold 60, they are opposite to the first hot press upper mold 30 and the second hot press upper mold 50 and face downward, their pulp suction holes and air suction holes are located on the top of the mold face, when the vapor is sucked to the air chamber and converted into water, the water will easily enter the air suction intermediate tube due to its gravitation. Therefore, it will be fine as long as the bottom position of the inner end of the air suction intermediate tube is at the same level as the air chamber. It does not have to be deliberately lower.

Similarly, in the case of the first hot press upper mold 30 for example, as shown in FIG. 10-FIG. 13, a plurality of blowing holes 335 (as shown in FIG. 12) are configured on the mold face of the mold 33 at each pulp suction part. The blowing holes 335 all go into the mold 33 and upward to an air inlet tube 336 (as shown in FIG. 13). Then, the air inlet tubes 336 will be connected to an air inlet mechanism for air intake. The blowing holes 335 and the air inlet tubes 336 are configured separately. They do not use the air suction holes 331 and the air chamber 332 because of the risk that, during the blowing process, the carbonized fibers deposited inside the air chamber 332 might be blown onto the mold face and the finished pulp molding product. Therefore, the separate configuration of the blowing holes 335 and the air inlet tube 336 can completely avoid the problem that the carbonized fibers deposited inside the air chamber 332 may be blow onto the mold face and the finished pulp molding product, ensuring cleanness of the mold face and the pulp molding product. The second hot press upper mold 50, the first hot press lower mold 40, and the second hot press lower mold 60 are also configured with independent blowing holes and air inlet tubes, i.e., they are completely the same as the structure shown in FIG. 10-FIG. 13, and are therefore not depicted and described again.

To summarize, the present invention truly has novelty and practical inventive step, and therefore an application for invention is hereby submitted. Your examination and earliest approval will be highly appreciated.

What is claimed:

1. An automatic forming machine for pulp molding products, comprising:

a pulp box, fixedly installed inside a central space, wherein a pulp material is contained inside the pulp box and a top surface of the pulp box comprises an opening;

a pulp suction mold, positioned in the central space and supported by a supporting piece passing through the pulp box to be in an upward state, wherein the supporting piece can perform a lifting action to drive the pulp suction mold to lift synchronously and in a zeroing state, the pulp suction mold is driven by the supporting piece to immerse in the pulp box and the pulp suction mold is connected with a first pumping device and capable of receiving a suction action or a blow action of the first pumping device, the suction action of the first pumping device forming a blank material layer on a mold face of the pulp suction mold;

a hot press upper mold, installed inside a side space and hung on a guide rail, wherein the side space is adjacent to the central space and located at one side of the central space, a mold face of the hot press upper mold faces downwardly and the mold face of the hot press upper mold and the mold face of the pulp suction mold are correspondingly symmetrical in shapes, the hot press upper mold is driven by an external power mechanism to perform a horizontally transverse movement along the guide rail, the hot press upper mold is connected with a second pumping device and capable of receiving the suction action or blow action of the second pumping device, the hot press upper mold configured to transport the blank material layer from the central space to the side space;

a hot press lower mold, installed inside the side space and located under the hot press upper mold, a mold face of the hot press lower mold faces upwardly, the mold face of the hot press lower mold and the mold face of the hot press upper mold are correspondingly symmetrical in shapes, a bottom of the hot press lower mold is driven by an external power mechanism to perform vertically up and down movement, and the hot press lower mold is connected with a third pumping device and capable of receiving the suction action or blow action of the third pumping device-; and wherein, further comprising, a material receiving mechanism configured outside the side space, wherein the material receiving mechanism has a vertical base resting on a fixed position and a straight rail is configured on a side of the vertical base; a horizontal rail is transversely and crossly configured on the straight rail, the horizontal rail extends a large section toward the side space, the horizontal rail can be pushed by an external power mechanism to perform an up and down movement along the straight rail and be controlled to stop moving anytime; a rail block is clamped on the horizontal rail and pushed by an external power mechanism to move transversely along the horizontal rail and can be controlled to stop moving anytime; and, a sliding bar is fixed under the rail block and the sliding bar can move transversely along the horizontal rail accompanying with the rail block and stop anytime accompanying with the rail block, the sliding bar extends a large section toward the side space and an adsorption member is configured below the sliding bar to generate an adsorption effect due to the connection with a vacuum suction mechanism;

wherein the hot press upper mold comprises a first hot press upper mold and a second hot press upper mold, wherein the first hot press upper mold and the second hot press upper mold are respectively disposed inside a first side space and a second side space, both of the first side space and the second side space are opposing sides of the central space and adjacent to the central space and respectively located at the two sides of the central space;

wherein, the first hot press upper mold directly receives the blank material layer from the pulp suction mold positioned in the central space, and wherein the first hot press upper mold transports the blank material layer from the central space to the first side space, and wherein the second hot press upper mold directly receives an additional blank material layer from the pulp suction mold positioned in the central space, and wherein the second hot press upper mold transports the blank material layer from the central space to the second side space.

2. The automatic forming machine for pulp molding products of The automatic forming machine for pulp molding products of claim 1, wherein, the first hot press upper mold and the second hot press upper mold hung on the same guide rail configured to pass through the upper space of the first side space, the central space and the second side space, both the mold faces of the first hot press upper mold and the second hot press upper mold face downward, both the mold faces of the first hot press upper mold and the second hot press upper mold and the mold face of the pulp suction mold are correspondingly symmetrical in shapes, both the first hot press upper mold and the second hot press upper mold are driven by an external power mechanism to perform a horizontally transverse movement along the guide rail, the first hot press upper mold and the second hot press upper mold are both connected with a pumping device and able to receive the suction action and blow action of the pumping device; the hot press lower mold comprises a first hot press lower mold and a second hot press lower mold, the first hot press lower mold and the second hot press lower mold are respectively installed inside the first side space and the second side space, the first hot press lower mold and the second hot press lower mold are respectively disposed below the first hot press upper mold and the second hot press upper mold, both the mold faces of the first hot press lower mold and the second hot press lower mold face upward, the mold faces of the first hot press lower mold and the second hot press lower mold are respectively symmetrical with the first hot press upper mold and the second hot press upper mold, the bottoms of the first hot press lower mold and the second hot press lower mold are both driven by an external power mechanism to perform a vertically up and down movement, and the first hot press lower mold and the second hot press lower mold are both connected with a pumping device and able to receive the suction and blow action of the pumping device.

3. The automatic forming machine for pulp molding products of claim 2, wherein the material receiving mechanism comprises a first material receiving mechanism and a second material receiving mechanism respectively installed exterior to the first side space and the second side space.

4. The automatic forming machine for pulp molding products of claim 1, wherein the hot press upper mold is provided with a plurality of air extraction holes on a plurality of pulp suction parts on the mold face of a mold table, the air extraction holes are direct upward to the interior of the mold and further to arrive at an air chamber, the air chamber is outward through an air extraction middle section tube and bends downwardly to communicate to an air extraction gathering tube, the air is sucked by the air extraction mechanism connected with the air extraction gathering tube, and when the inner end of the air extraction middle tube is connected to the air chamber, the lower position of the inner end of the air extraction middle tube is lower than the air chamber.

5. The automatic forming machine for pulp molding products of claim 1, wherein the mold faces of mold tables of the hot press upper mold and the hot press lower mold are configured with a plurality of air blowing holes at each pulp suction part, the plurality of air blowing holes towards to the interior of the mold tables go upwardly or downwardly to an air inlet tube and the air inlet tube is connected and collected for air intake via an air intake mechanism.

* * * * *